US012644440B2

(12) United States Patent
Crockett et al.

(10) Patent No.: US 12,644,440 B2
(45) Date of Patent: Jun. 2, 2026

(54) POSITIVE DISPLACEMENT PUMP

(71) Applicant: Binks US, LLC, Scottsdale, AZ (US)

(72) Inventors: Randy Crockett, Scottsdale, AZ (US); Joshua Miller, Scottsdale, AZ (US); Mike Thomas, Dundas (CA); Darin Burgess, Sale Creek, TN (US)

(73) Assignee: BINKS US, LLC, Shoreview, MN (US)

( * ) Notice: Subject to any disclaimer, the term of this patent is extended or adjusted under 35 U.S.C. 154(b) by 0 days.

(21) Appl. No.: 18/692,682

(22) PCT Filed: Aug. 25, 2023

(86) PCT No.: PCT/US2023/031138

§ 371 (c)(1),
(2) Date: Mar. 15, 2024

(87) PCT Pub. No.: WO2024/044353

PCT Pub. Date: Feb. 29, 2024

(65) Prior Publication Data

US 2024/0401577 A1 Dec. 5, 2024

Related U.S. Application Data

(60) Provisional application No. 63/400,950, filed on Aug. 25, 2022.

(51) Int. Cl.

| | |
|---|---|
| ***F04B 1/12*** | (2020.01) |
| ***F04B 1/02*** | (2006.01) |
| ***F04B 23/06*** | (2006.01) |

(52) U.S. Cl.
CPC ..... *F04B 1/12* (2013.01); *F04B 1/02* (2013.01); *F04B 23/06* (2013.01)

(58) Field of Classification Search
CPC .... F04B 1/12; F04B 1/02; F04B 23/06; F04B 2205/01–2205/05
See application file for complete search history.

(56) References Cited

U.S. PATENT DOCUMENTS

| | | | | | |
|---|---|---|---|---|---|
| 3,070,023 | A * | 12/1962 | Glasgow | F01L 23/00 | 91/305 |
| 3,312,172 | A * | 4/1967 | Harklau | F01L 23/00 | 417/393 |
| 2009/0321475 | A1* | 12/2009 | Schultz | F04B 23/06 | 222/63 |
| 2010/0278668 | A1* | 11/2010 | Trout | F04B 23/06 | 417/487 |

(Continued)

*Primary Examiner* — Bryan M Lettman
(74) *Attorney, Agent, or Firm* — Greenberg Traurig LLP; Michael K. Dixon

(57) ABSTRACT

An apparatus can include a central member between a first fluid section and a second fluid section, wherein the central member, first fluid section, and second fluid section define a longitudinal axis thereon, at least one first fluid section driving member in mechanical communication with the central member, at least one second fluid section driving member in mechanical communication with the central member, an oscillating member in mechanical communication with the central member configured to oscillate the central member along the longitudinal axis, a pump inlet in fluid communication with a fluid source, and a pump outlet.

20 Claims, 3 Drawing Sheets

(56) References Cited

U.S. PATENT DOCUMENTS

| | | | | |
|---|---|---|---|---|
| 2010/0290937 | A1* | 11/2010 | Trout | F04B 23/06 417/418 |
| 2012/0282112 | A1* | 11/2012 | Nip | F04B 43/043 417/48 |
| 2016/0230786 | A1* | 8/2016 | Nema | F15B 3/00 |
| 2017/0167476 | A1* | 6/2017 | Bozic | F04B 11/005 |
| 2018/0216613 | A1* | 8/2018 | Beisel | F04B 53/00 |
| 2019/0195213 | A1* | 6/2019 | Burrows | F04B 35/04 |
| 2022/0120260 | A1* | 4/2022 | Bignon | F03C 1/0073 |

* cited by examiner

POSITIVE DISPLACEMENT PUMP

CROSS-REFERENCE TO RELATED APPLICATIONS

This application is a 35 U.S.C. § 371 National Stage Application of PCT/US2023/031138, filed 25 Aug. 2023, titled "Positive Displacement Pump," which was a continuation of U.S. Provisional Application 63/400,950, filed 25 Aug. 2022, both from which the benefit is claimed and are incorporated as if fully rewritten herein.

BACKGROUND

Disclosed is a positive displacement pump, and specifically, a positive displacement pump configured for continuous flow.

SUMMARY

An apparatus can include a central member between a first fluid section and a second fluid section, wherein the central member, first fluid section, and second fluid section define a longitudinal axis thereon, at least one first fluid section driving member in mechanical communication with the central member, at least one second fluid section driving member in mechanical communication with the central member, an oscillating member in mechanical communication with the central member configured to oscillate the central member along the longitudinal axis, a pump inlet in fluid communication with a fluid source, and a pump outlet A method of operating a pump can include providing a pump comprising a first fluid section, a second fluid section, a first fluid section inlet valve, a first fluid section outlet valve, a second fluid section inlet valve, a second fluid section outlet valve, a control unit, and a central member between the first fluid section and second fluid section, operating the pump in a first mode, wherein fluid is drawn from a fluid source into the first fluid section while fluid exits the pump from a second fluid section; and, operating the pump in a second mode, wherein fluid is drawn from a fluid source into the second fluid section while fluid exits the pump from a second fluid section.

DETAILED DESCRIPTION

Figure 1:
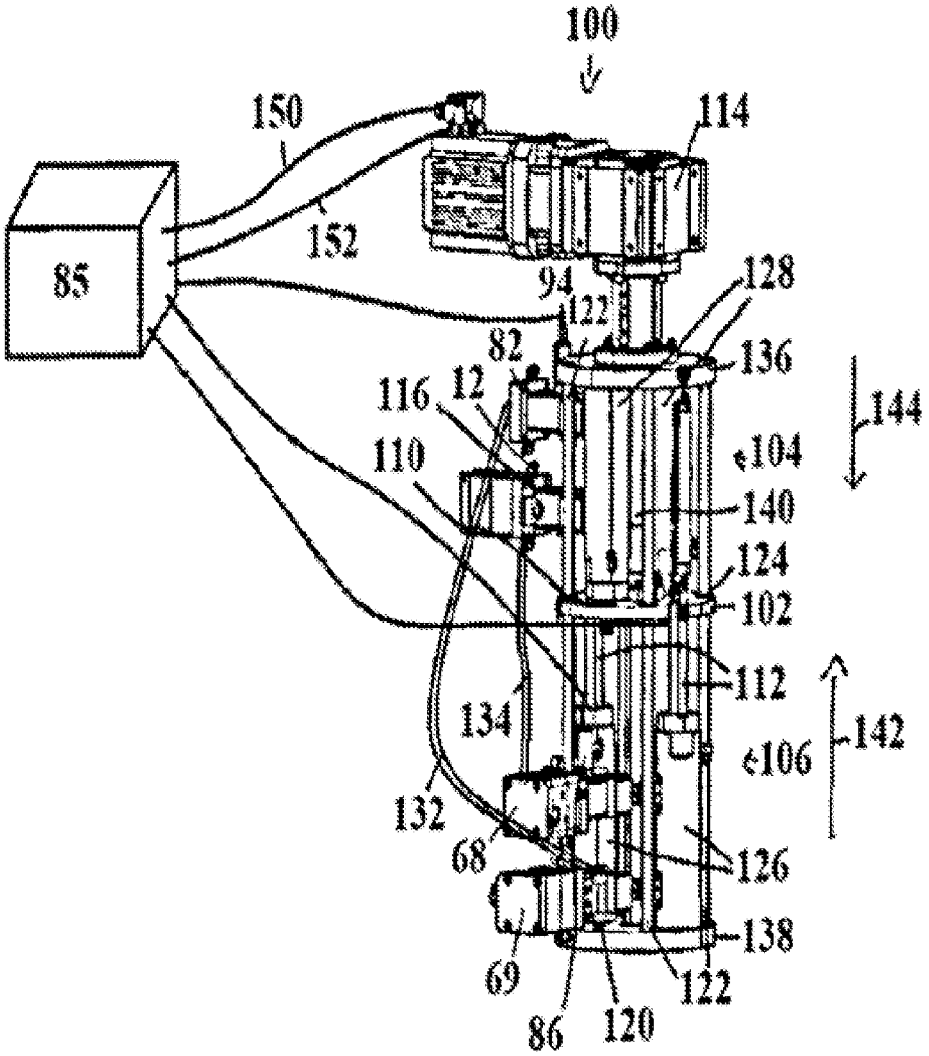
FIG. 1 is an example, non-limiting illustration of the apparatus described herein.
Figure 2:
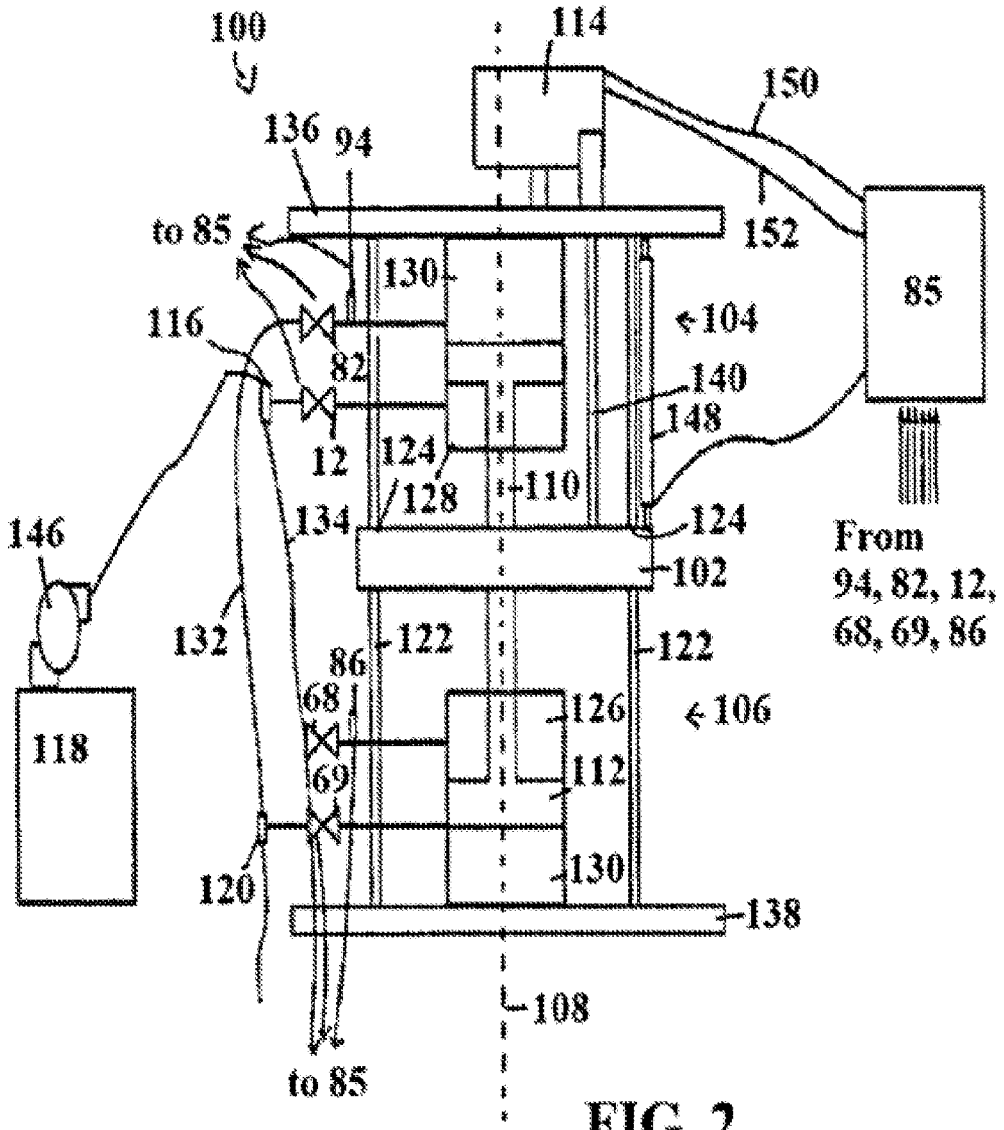
FIG. 2 is an example, non-limiting block diagram of the apparatus described herein FIG. is an example, non-limiting block diagram of a method described herein.
Figure 3:
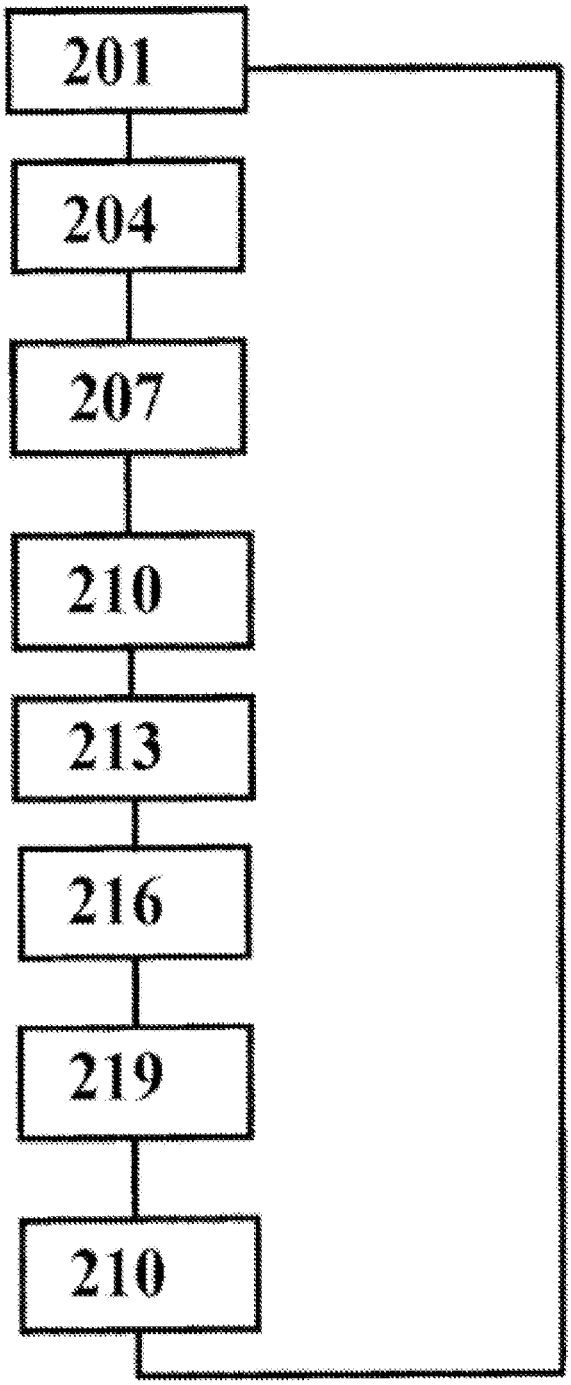

As shown in FIGS. 1-3, an apparatus 100 can include a central member 102 between a first fluid section 104 and a second fluid section 106, wherein the central member 102, first fluid section 104, and second fluid section 106 define a longitudinal axis 108 thereon, at least one first fluid section driving member 110 in mechanical communication with the central member 102, at least one second fluid section driving member 112 in mechanical communication with the central member 102, an oscillating member 114 in mechanical communication with the central member 102 configured to oscillate the central member 102 along the longitudinal axis 108; a pump inlet 116 in fluid communication with a fluid source 118; and a pump outlet 120. The first fluid section 104 can include a first fluid section chamber 128 or a plurality of first fluid section chambers 128. The first fluid section 104 can include a first fluid section end cap 136. The second fluid section 106 can include a second fluid section chamber 126 or a plurality of second fluid section chambers 126. The second fluid section 106 can include a first fluid section end cap 136. The first fluid section chamber 128 or chambers can be mounted to the first fluid section end cap 136 and the second fluid section chamber 126 or chambers can be mounted to the second fluid section end cap 138. The oscillating member 114 can be mounted to the first fluid section end cap 136 or second fluid section end cap 138. The fluid source 118 can comprise a fluid, wherein the fluid comprises a sealant, adhesive, liquid-applied sound deadener, glass beads, hollow glass beads, and combinations thereof. The fluid source 118 can include a transition pump 146. An end cap hole in either the first end cap or second end cap can allow a spindle 140 to pass through the end cap to connect the oscillating member 114 to the central member 102. The oscillating member 114 can be a motor 114 operating a ballscrew, which can be configured to move a spindle 140 in either of a first direction 142 and second direction 144, which, by being mounted to the central member 102, can move the central member 102 in either direction along the longitudinal axis 108. The motor 114 can be operatively coupled to a control unit 85 to receive signals dictating the direction of the spindle 140 by a motor 114 control cable 150 and power by a power cable 152. The oscillating member 114 can communicate to the control unit 85, by the control cable 150, a position of the central member 102 or any of the driving members. The oscillating member 114 direction can be controlled by the control unit 85 by the control cable 150 or power cable 152. In some embodiments, the apparatus 100 can include at least one connecting guide shaft 122, wherein the at least one connecting guide shaft 122 can be attached to the first fluid section 104 and second fluid section 106, and wherein the at least one connecting guide shaft 122 can be configured to guide the central member 102 along the longitudinal axis 108. In some embodiments, the guide shafts 122 can connect to the first fluid section end cap 136 and second fluid section end cap 138. In some embodiments, the apparatus 100 can provide that the at least one connecting guide shaft 122 can be at least three or at least four connecting guide shafts 122, and wherein the at least three or at least four connecting guide shafts 122 guide the central member 102 along the longitudinal axis 108 by extending through a plurality of holes 124 in the central member 102. According to certain embodiments, the first fluid section 104 comprises at least one first fluid section chamber 128 circumscribing at least a portion of the at least one first fluid section driving member 110, wherein the at least one first fluid section chamber 128 can be configured to receive fluid from the fluid source 118 through the inlet. In some embodiments, the at least one first fluid section driving member 110 can be at least two first fluid section driving members 110, the at least one first fluid section chamber 128 can be at least two first fluid section chambers 128, and each of the at least two first section fluid chambers circumscribe at least a portion of each of the at least two first fluid section driving members 110. The at least one first fluid section driving member 110 and at least one second fluid section driving member 112 can be a piston, rod, plunger, or diaphragm. In some embodiments, movement of the central member 102 toward the first fluid section 104 can be configured to drive a first fluid section 104 volume 130 from within the first fluid section 104, sequentially, through a first fluid section 104 outlet, through a first fluid section 104 outlet valve 82, through a first conduit 132, to the pump outlet 120. In some embodiments, movement of the central member 102 away from the first fluid section 104 can be configured to draw fluid from the fluid source 118, sequentially, through the inlet, through a first fluid section 104 inlet valve 12, to the first fluid section 104. In certain embodiments, the first fluid section 104 comprises a first fluid section pressure sensor 94. According to some embodiments, the first fluid section pressure sensor 94 can be configured to detect a pressure between the first fluid section 104 outlet valve 82 and the first fluid section 104. In some embodiments, movement of the central member 102 toward the second fluid section 106 can be configured to drive a second fluid section 106 volume 130 from within the second fluid section 106, sequentially, through a second fluid section outlet valve 69, to the pump outlet 120. In certain embodiments, movement of the central member 102 away from the second fluid section 106 can be configured to draw fluid from the fluid source 118, sequentially, through the inlet, through a second conduit 134, through a second fluid section inlet valve 68, to the second fluid section 106. The first fluid section 104 inlet valve 12, first fluid section 104 outlet valve 82, second fluid section inlet valve 68, and second fluid section outlet valve 69 can be a check valve, solenoid operated valve, ball valve, or combinations thereof, and can be rigidly mounted to their respective fluid sections. According to some embodiments, the second fluid section 106 comprises a second fluid section pressure sensor 86, wherein the second fluid section pressure sensor 86 can be configured to detect a pressure between the second fluid section inlet valve 68 and the second fluid section 106. In certain embodiments, the control unit 85 operatively coupled to a potentiometer 148, the first fluid section pressure sensor 94, the second fluid section pressure sensor 86, the first fluid section 104 inlet valve 12, the second fluid section inlet valve 68, the first fluid section 104 outlet valve 82, the second fluid section outlet valve 69, and the oscillating member 114. and wherein the control unit 85 can be configured to receive a user defined inlet pressure setpoint and a user defined outlet pressure setpoint. In certain embodiments, the control unit 85 can be configured to open and close the first fluid section 104 inlet valve 12, the second fluid section inlet valve 68, the first fluid section 104 outlet valve 82, and the second fluid section outlet valve 69 based on one of a group including a central member 102 position, a first fluid section driving member 110 position a second fluid section driving member 112 position, a first fluid section 104 pressure, a second fluid section 106 pressure; and combinations thereof, wherein the central member 102 position, first fluid section driving member 110 position, and second fluid section driving member 112 position can be inferred based on the potentiometer 148 or an encoder signal from the oscillating member 114, wherein the first fluid section 104 pressure can be detected by the first fluid section pressure sensor 94, and wherein the section fluid section pressure can be detected by the second fluid section pressure sensor 86, any of which can constitute an operating condition.

In some embodiments, based on a momentary direction of a movement of the central member 102, one of the group consisting of the first fluid section 104 and the second fluid section 106 is a compressed section, and wherein one of a group consisting of the first fluid section 104 and the second fluid section 106 is an expanded section, wherein the expanded fluid section and compressed fluid section are distinct. If the central member 102 is moving toward the first fluid section 104, in a first direction 142, the first fluid section 104 is the compressed section and the second fluid section 106 is the expanded section. If the central member 102 is moving toward the second fluid section 106, the second direction 144, the second fluid section 106 is the compressed section and the first fluid section 104 is the expanded section. The first pressure sensor is an expanded pressure sensor if the first fluid section 104 is the expanded section and the first pressure sensor is a compressed pressure sensor if the first fluid section 104 is the compressed section, and the second pressure sensor is an expanded pressure sensor if the second fluid section 106 is the expanded section and the second pressure sensor is a compressed pressure sensor if the second fluid section 106 is the compressed section, and the expanded pressure sensor detects an expanded pressure and the compressed pressure sensor detects a compressed pressure. The first fluid section 104 inlet valve 12 is an expanded inlet valve if the first fluid section 104 is the expanded section and the first fluid section 104 inlet valve 12 is a compressed inlet valve if the first fluid section 104 is the compressed section, wherein the second fluid section inlet valve 68 is the expanded inlet valve if the second fluid section 106 is the expanded section and the second fluid section inlet valve 68 is the compressed inlet valve if the second fluid section 106 is the compressed section, and the first fluid section 104 outlet valve 82 is an expanded outlet valve if the first fluid section 104 is the expanded section and the first fluid section 104 outlet valve 82 is a compressed outlet valve if the first fluid section 104 is the compressed section, and the second fluid section outlet valve 69 is the expanded outlet valve if the second fluid section 106 is the expanded section and the second fluid section outlet valve 69 is the compressed outlet valve if the second fluid section 106 is the compressed section. The control unit 85 can be configured to transition from an operating mode to a transition mode by opening the expanded section outlet valve and closing the compressed section inlet valve based on an operating condition detection and transition from a transition mode to an operating mode by closing the compressed section outlet valve, opening the compressed section inlet valve, and reversing the central member 102 direction based on detection that the expanded pressure and compressed pressure are within a pressure threshold.

A method of pumping a fluid can include providing providing a pump comprising a first fluid section 104, a second fluid section 106, a first fluid section 104 inlet valve 12, a first fluid section 104 outlet valve 82, a second fluid section inlet valve 68, a second fluid section outlet valve 69, a control unit 85, and a central member 102 between the first fluid section 104 and second fluid section 106, operating the pump in a first mode 201, wherein fluid can be drawn from a fluid source 118 into the first fluid section 104 while fluid exits the pump from a second fluid section 106; and operating the pump in a second mode 213, wherein fluid can be drawn from a fluid source 118 into the second fluid section 106 while fluid exits the pump from a second fluid section 106. The pump can be the apparatus 100 of the present embodiments. While operating the pump in the first mode 201, the first fluid section 104 inlet valve 12 can be open, first fluid section 104 outlet valve 82 can be shut, second fluid section inlet valve 68 can be shut, and second fluid section outlet valve 69 can be open. In some embodiments, while operating the pump in the first mode 201, the central member 102 moves in a first direction 142 along a longitudinal axis 108 away from the first fluid section 104 and toward the second fluid section 106. In certain embodiments, while operating the pump in the second mode 213, the first fluid section 104 inlet valve 12 can be shut, the first fluid section 104 outlet valve 82 can be open, the second fluid section inlet valve 68 can be open, and the second fluid section outlet valve 69 can be shut. In some embodiments, while operating the pump in the first mode 201, the central member 102 moves in a second direction 144 along a longitudinal axis 108 away from the second fluid section 106 and toward the first fluid section 104. According to some embodiments, the apparatus 100 can be operated in a first transition mode 207, wherein the first fluid section 104 inlet valve 12 and second fluid inlet valve are shut, the first fluid section 104 outlet valve 82 and second fluid outlet valve are open, and the central member 102 moves in a first direction 142 along a longitudinal axis 108 away from the first fluid section 104 and toward the second fluid section 106. In some embodiments, the apparatus 100 can be operated by detecting a first operating condition and switching from operating the pump in the first mode 201 to operating the pump in the first transition mode 207 based on detection of the first operating condition. In some embodiments, the apparatus 100 can be operated by operating the pump in a second transition mode 219, wherein the first fluid section 104 inlet valve 12 and second fluid inlet valve are shut, the first fluid section 104 outlet valve 82 and second fluid section outlet valve 69 are open, and the central member 102 moves in a second direction 144 along a longitudinal axis 108 away from the second fluid section 106 and toward the first fluid section 104. In some embodiments, the apparatus 100 can be operated by detecting a second operating condition, switching from operating the pump in the second mode 213 to operating the pump in the second transition mode 219 based on detection of the second operating condition. In some embodiments, the apparatus 100 can be operated by detecting a first fluid section 104 pressure with the first fluid section pressure sensor 94; and detecting a second fluid section 106 pressure with the second fluid section pressure sensor 86. In certain embodiments, the apparatus 100 can be operated by comparing the first fluid section 104 pressure and second fluid section 106 pressure, detecting that the first fluid section 104 pressure and second fluid section 106 pressure are within a pressure threshold 210. The control unit 85 can be configured to detect the operating conditions, compare the operating conditions, and switch the modes of operation by opening and shutting the required valves as needed and changing the direction of movement of the central member 102 as needed. The apparatus 100 can further be operated by switching from operating the pump in the first transition mode 207 to operating the pump in the second mode 213 based on the detecting that the first fluid section 104 pressure and second fluid section 106 pressure are within the pressure threshold 210. This can constitute pressure balancing to allow for smooth, continuous flow at the outlet. In some embodiments, the apparatus 100 can further be operated by switching from operating the pump in the second transition mode 219 to operating the pump in the first mode 201 based on the detecting that the first fluid section 104 pressure and second fluid section 106 pressure are within the pressure threshold 210. According to certain embodiments, the apparatus 100 can be operated by performing the steps, in order, operating the pump in the first mode 201, operating the pump in the first transition mode 207; operating the pump in the second mode 213, and operating the pump in the second transition mode 219;

In some embodiments, the apparatus 100 can be operated by cyclically performing the steps, in order, operating the pump in the first mode 201, detecting, by a control unit 85, the first operating condition, wherein the first operating condition can be the central member 102 position reaching a second fluid section 106 position threshold 204, switching from operating the pump in the first mode 201 to operating the pump in the first transition mode 207 by the control unit 85 opening the first fluid section 104 outlet valve 82 shutting the first fluid section 104 inlet valve 12, operating the pump in the first transition mode 207; detecting that the first fluid section 104 pressure and second fluid section 106 pressure are within the pressure threshold 210; switching from operating the pump in the first transition mode 207 to operating the pump in the second mode 213 by the control unit 85 shutting the second fluid section outlet valve 69, opening the second fluid section inlet valve 68, and changing a direction of central member 102 movement from the first direction 142 to the second direction 144, operating the pump in the second mode 213, detecting the second operating condition, wherein the second operating condition can be the central member 102 position reaching a first fluid section 104 position threshold 216, operating the pump in the second transition mode 219, detecting that the first fluid section 104 pressure and second fluid section 106 pressure are within the pressure threshold 210; and switching from operating the pump in the second transition mode 219 to operating the pump in the first mode 201 by the control unit 85 shutting the first fluid section 104 outlet valve 82, opening the first fluid section 104 inlet valve 12, and changing the direction of central member 102 movement from the second direction 144 to the first direction 142. Thus, illustrative embodiments of the present invention provide a method and apparatus 100 for pumping a fluid. The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiment. The terminology used herein was chosen to best explain the principles of the embodiment, the practical application or technical improvement over technologies found in the marketplace, or to enable others of ordinary skill in the art to understand the embodiments disclosed here.

The Figures illustrate the architecture, functionality, and operation of possible implementations of the apparatus 100 and method according to various embodiments of the present invention. In this regard, each portion in the Figures may represent a module, segment, portion of code, piece or pieces of machinery. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

We claim:

1. An apparatus comprising:

a central member between a first fluid section and a second fluid section, wherein the central member, first fluid section, and second fluid section define a longitudinal axis thereon;

at least one first fluid section driving member in mechanical communication with the central member; at least one second fluid section driving member in mechanical communication with the central member;

an oscillating member in mechanical communication with the central member configured to oscillate the central member along the longitudinal axis;

a pump inlet in fluid communication with a fluid source;

a pump outlet;

at least one connecting guide shaft, wherein the at least one connecting guide shaft is attached to the first fluid section and second fluid section, and wherein the at least one connecting guide shaft is configured to guide the central member along the longitudinal axis; and wherein the at least one connecting guide shaft is at least three connecting guide shafts, and wherein the at least three connecting guide shafts guide the central member along the longitudinal axis by extending through a plurality of holes in the central member.

2. The apparatus of claim 1, wherein the first fluid section comprises at least one first fluid section chamber circumscribing at least a portion of the at least one first fluid section driving member, wherein the at least one first fluid section chamber is configured to receive fluid from the fluid source through the inlet.

3. The apparatus of claim 1, further comprising a control unit operatively coupled to a potentiometer, at least one pressure sensor, at least one fluid section inlet valve and at least one fluid section outlet valve.

4. The apparatus of claim 1, wherein movement of the central member toward the first fluid section is configured to drive a first fluid section volume from within the first fluid section, sequentially, through a first fluid section outlet, through a first fluid section outlet valve, through a first conduit, to the pump outlet.

5. An apparatus comprising:

a central member between a first fluid section and a second fluid section, wherein the central member, first fluid section, and second fluid section define a longitudinal axis thereon;

at least one first fluid section driving member in mechanical communication with the central member; at least one second fluid section driving member in mechanical communication with the central member;

an oscillating member in mechanical communication with the central member configured to oscillate the central member along the longitudinal axis;

a pump inlet in fluid communication with a fluid source;

a pump outlet;

wherein the first fluid section comprises at least one first fluid section chamber circumscribing at least a portion of the at least one first fluid section driving member, wherein the at least one first fluid section chamber is configured to receive fluid from the fluid source through the inlet; and wherein the at least one first fluid section driving member is at least two first fluid section driving members, the at least one first fluid section chamber is at least two first fluid section chambers, and each of the at least two first section fluid chambers circumscribe at least a portion of each of the at least two first fluid section driving members.

6. The apparatus of claim 5, further comprising at least one connecting guide shaft, wherein the at least one connecting guide shaft is attached to the first fluid section and second fluid section, and wherein the at least one connecting guide shaft is configured to guide the central member along the longitudinal axis.

7. The apparatus of claim 5, wherein movement of the central member toward the first fluid section is configured to drive a first fluid section volume from within the first fluid section, sequentially, through a first fluid section outlet, through a first fluid section outlet valve, through a first conduit, to the pump outlet.

8. The apparatus of claim 7, wherein movement of the central member toward the second fluid section is configured to drive a second fluid section volume from within the second fluid section, sequentially, through a second fluid section outlet valve, to the pump outlet.

9. The apparatus of claim 8, wherein movement of the central member away from the second fluid section is configured to draw fluid from the fluid source, sequentially, through the inlet, through a second conduit, through a second fluid section inlet valve, to the second fluid section.

10. The apparatus of claim 5, wherein movement of the central member away from the first fluid section is configured to draw fluid from the fluid source, sequentially, through the inlet, through a first fluid section inlet valve, to the first fluid section.

11. The apparatus of claim 5, wherein the first fluid section comprises a first fluid section pressure sensor.

12. The apparatus of claim 5, further comprising at least one connecting guide shaft, wherein the at least one connecting guide shaft is attached to the first fluid section and second fluid section, and wherein the at least one connecting guide shaft is configured to guide the central member along the longitudinal axis.

13. The apparatus of claim 5, further comprising a control unit operatively coupled to a potentiometer, at least one pressure sensor, at least one fluid section inlet valve and at least one fluid section outlet valve.

14. An apparatus comprising:

a central member between a first fluid section and a second fluid section, wherein the central member, first fluid section, and second fluid section define a longitudinal axis thereon;

at least one first fluid section driving member in mechanical communication with the central member; at least one second fluid section driving member in mechanical communication with the central member;

an oscillating member in mechanical communication with the central member configured to oscillate the central member along the longitudinal axis;

a pump inlet in fluid communication with a fluid source;

a pump outlet;

wherein movement of the central member toward the first fluid section is configured to drive a first fluid section volume from within the first fluid section, sequentially, through a first fluid section outlet, through a first fluid section outlet valve, through a first conduit, to the pump outlet;

wherein the first fluid section comprises a first fluid section pressure sensor; and wherein the first fluid section pressure sensor is configured to detect a pressure between the first fluid section outlet valve and the first fluid section.

15. The apparatus of claim 14, further comprising at least one connecting guide shaft, wherein the at least one connecting guide shaft is attached to the first fluid section and second fluid section, and wherein the at least one connecting guide shaft is configured to guide the central member along the longitudinal axis.

16. The apparatus of claim 14, further comprising a control unit operatively coupled to a potentiometer, at least one pressure sensor, at least one fluid section inlet valve and at least one fluid section outlet valve.

17. An apparatus comprising:

a central member between a first fluid section and a second fluid section, wherein the central member, first fluid section, and second fluid section define a longitudinal axis thereon;

at least one first fluid section driving member in mechanical communication with the central member; at least one second fluid section driving member in mechanical communication with the central member;

an oscillating member in mechanical communication with the central member configured to oscillate the central member along the longitudinal axis;

a pump inlet in fluid communication with a fluid source; a pump outlet;

wherein movement of the central member toward the first fluid section is configured to drive a first fluid section volume from within the first fluid section, sequentially, through a first fluid section outlet, through a first fluid section outlet valve, through a first conduit, to the pump outlet;

wherein movement of the central member toward the second fluid section is configured to drive a second fluid section volume from within the second fluid section, sequentially, through a second fluid section outlet valve, to the pump outlet;

wherein movement of the central member away from the second fluid section is configured to draw fluid from the fluid source, sequentially, through the inlet, through a second conduit, through a second fluid section inlet valve, to the second fluid section;

wherein the second fluid section comprises a second fluid section pressure sensor, wherein the second fluid section pressure sensor is configured to detect a pressure between the second fluid section inlet valve and the second fluid section.

18. The apparatus of claim 17, further comprising a control unit operatively coupled to a potentiometer, the first fluid section pressure sensor, the second fluid section pressure sensor, the first fluid section inlet valve, the second fluid section inlet valve, the first fluid section outlet valve, the second fluid section outlet valve, and the oscillating member, and wherein the control unit is configured to receive a user defined inlet pressure setpoint and a user defined outlet pressure setpoint.

19. The apparatus of claim 18, wherein the control unit is configured to open and close the first fluid section inlet valve, the second fluid section inlet valve, the first fluid section outlet valve, and the second fluid section outlet valve based on one of a group consisting of:

a central member position;

a first fluid section driving member position;

a second fluid section driving member position;

a first fluid section pressure;

a second fluid section pressure; and combinations thereof, wherein the central member position, first fluid section driving member position, and second fluid section driving member position can be inferred based on the potentiometer or an encoder signal from the oscillating member, wherein the first fluid section pressure can be detected by the first fluid section pressure sensor; and wherein the section fluid section pressure can be detected by the second fluid section pressure sensor.

20. The apparatus of claim 19, wherein, based on a momentary direction of a movement of the central member, one of the group consisting of the first fluid section and the second fluid section is a compressed section, and wherein one of a group consisting of the first fluid section and the second fluid section is an expanded section, wherein the expanded fluid section and compressed fluid section are distinct, wherein the first pressure sensor is an expanded pressure sensor if the first fluid section is the expanded section and the first pressure sensor is a compressed pressure sensor if the first fluid section is the compressed section, wherein the second pressure sensor is an expanded pressure sensor if the second fluid section is the expanded section and the second pressure sensor is a compressed pressure sensor if the second fluid section is the compressed section, wherein the expanded pressure sensor detects an expanded pressure and the compressed pressure sensor detects a compressed pressure, wherein the first fluid section inlet valve is an expanded inlet valve if the first fluid section is the expanded section and the first fluid section inlet valve is a compressed inlet valve if the first fluid section is the compressed section, wherein the second fluid section inlet valve is the expanded inlet valve if the second fluid section is the expanded section and the second fluid section inlet valve is the compressed inlet valve if the second fluid section is the compressed section, wherein the first fluid section outlet valve is an expanded outlet valve if the first fluid section is the expanded section and the first fluid section outlet valve is a compressed outlet valve if the first fluid section is the compressed section, wherein the second fluid section outlet valve is the expanded outlet valve if the second fluid section is the expanded section and the second fluid section outlet valve is the compressed outlet valve if the second fluid section is the compressed section, wherein the control unit is configured to perform at least one of the steps from the group consisting of: transitioning from an operating mode to a transition mode by opening the expanded section outlet valve and closing the compressed section inlet valve based on an operating condition detection; and transitioning from a transition mode to an operating mode by closing the compressed section outlet valve, opening the compressed section inlet valve, and reversing the central member direction based on detection that the expanded pressure and compressed pressure are within a pressure threshold.

* * * * *